US006435962B1

(12) United States Patent
Herron et al.

(10) Patent No.: US 6,435,962 B1
(45) Date of Patent: Aug. 20, 2002

(54) OPERATING MECHANISM FOR VENT LOUVER

(76) Inventors: Robert Herron, 2644 Sweet Maple Cove, Germantown, TN (US) 38139; Patrick Herron, 2470 Sandalwood Dr., El Centro, CA (US) 92243

( * ) Notice: Subject to any disclaimer, the term of this patent is extended or adjusted under 35 U.S.C. 154(b) by 0 days.

(21) Appl. No.: 09/678,975

(22) Filed: Oct. 5, 2000

Related U.S. Application Data

(60) Provisional application No. 60/158,274, filed on Oct. 7, 1999.

(51) Int. Cl.[7] ..... F24F 13/15

(52) U.S. Cl. ..... 454/290; 454/325

(58) Field of Search ..... 454/155, 240, 454/325, 335

(56) References Cited

U.S. PATENT DOCUMENTS

| | | | | |
|---|---|---|---|---|
| 34,783 | A | | 3/1862 | Sawyer |
| 770,326 | A | | 9/1904 | Slater |
| 848,758 | A | | 4/1907 | Meibeyer |
| 1,568,545 | A | | 1/1926 | Colgan |
| 3,456,574 | A | | 7/1969 | Jakeway |
| 3,487,768 | A | | 1/1970 | Watson |
| 3,552,295 | A | | 1/1971 | Armstrong |
| 3,677,166 | A | | 7/1972 | Sisk, Jr. et al. |
| 3,680,470 | A | * | 8/1972 | Neece |
| 3,682,085 | A | | 8/1972 | Dennis |
| 3,938,430 | A | | 2/1976 | Koppang |
| 4,093,119 | A | * | 6/1978 | Swisher |
| 4,274,330 | A | | 6/1981 | Witten et al. |
| 4,275,762 | A | | 6/1981 | Field |
| 4,587,892 | A | | 5/1986 | Witten et al. |
| 4,711,160 | A | | 12/1987 | Witten et al. |
| D315,790 | S | | 3/1991 | Koessler |
| 5,312,298 | A | | 5/1994 | Myers |
| 5,338,255 | A | | 8/1994 | Akehurst |
| 5,444,447 | A | | 8/1995 | Wingender |
| 5,496,213 | A | | 3/1996 | Miller |
| 5,569,077 | A | | 10/1996 | Lam et al. |
| 5,662,522 | A | | 9/1997 | Waltz |
| 5,733,191 | A | | 3/1998 | Lam et al. |
| 5,766,069 | A | | 6/1998 | Baek |
| 5,984,776 | A | * | 11/1999 | Berger |

* cited by examiner

*Primary Examiner*—Harold Joyce
(74) *Attorney, Agent, or Firm*—Calfee, Halter & Griswold LLP

(57) ABSTRACT

A vent register for controlling the flow of air from a heating and cooling duct system. The register includes a rack and pinion operating mechanism for controlling the movement of the damper louvers. The louvers are molded with an integral pinion gear and rotatably mounted within a rectangular housing. A slidably movable lever having a lineal rack of teeth is disposed within the housing. A portion of the lever protrudes above the face of the register for manipulation by the user and the rack of teeth engage the pinion gears of the louvers. The linear adjustment of the lever within the housing is translated to rotational adjustment of the louvers by the rack and pinion operating mechanism.

9 Claims, 3 Drawing Sheets

OPERATING MECHANISM FOR VENT LOUVER

RELATED APPLICATIONS

This application claims priority from U.S. Provisional Application No. 60/158,274 filed Oct. 7, 1999.

BACKGROUND OF THE INVENTION

I. Field of the Invention

This invention relates to vent dampers for controlling the flow of heated or cooled air through a vent, and, in particular, to an operating mechanism for opening and closing damper louvers.

II. Description of the Prior Art

Vent dampers are widely used to control the flow from heating and cooling systems into a specific room. Typical dampers include one or more louvers which can be moved between a closed position blocking flow through the damper and an open position. Rotatable louvers may be positioned to deflect air flow in a specific direction from the damper.

The control mechanism for moving the damper louvers have taken on a variety of configurations. The most common is a pivotable lever which simultaneously pivot the louvers. Such levers maintain a low profile yet facilitate simple operation of the damper. Alternatives include a rotatable gear which cooperates with toothed gears on the dampers. Rotation of the main gear transmits rotational motion to the dampers for control of air flow.

SUMMARY OF THE PRESENT INVENTION

The present invention overcomes the disadvantages of the prior known vent dampers by providing a rack and pinion mechanism for translating linear motion of a lever to rotation of the dampers.

The vent damper embodying the present invention generally comprises a rectangular housing configured to fit within an outlet opening of the vent. This opening may be formed within the floor, wall or ceiling of a room to direct air flow from the heating and cooling system. Disposed within the housing are a plurality of damper vanes or louvers for selectively blocking air flow through the housing. The louvers are rotatably mounted to the housing for rotation between a closed position substantially perpendicular to the flow passageway of the housing and a full open position substantially parallel to the air flow. The louvers include end hubs which are rotatably received in apertures formed in the housing wall to support the louvers within the housing.

Each of the louvers include a pinion gear for independent rotation control of the individual louvers. In a preferred embodiment, a partial pinion gear is molded as part of the louver in association with one of the end hubs. As a result, rotation of the pinion will rotate the louver about the axis of the hub.

Mounted to the housing is a slidable lever which protrudes above the face of the damper for manipulation by the user. The lever is slidably received within a channel formed in the housing wall and includes a linear rack of teeth adapted to cooperate with the teeth of the pinion gears. The rack teeth are disposed downwardly for engagement with the pinion teeth of the louvers. As a result, linear movement of the lever along the housing wall will transmit motion to the pinions to rotate the louvers between the open and closed positions.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
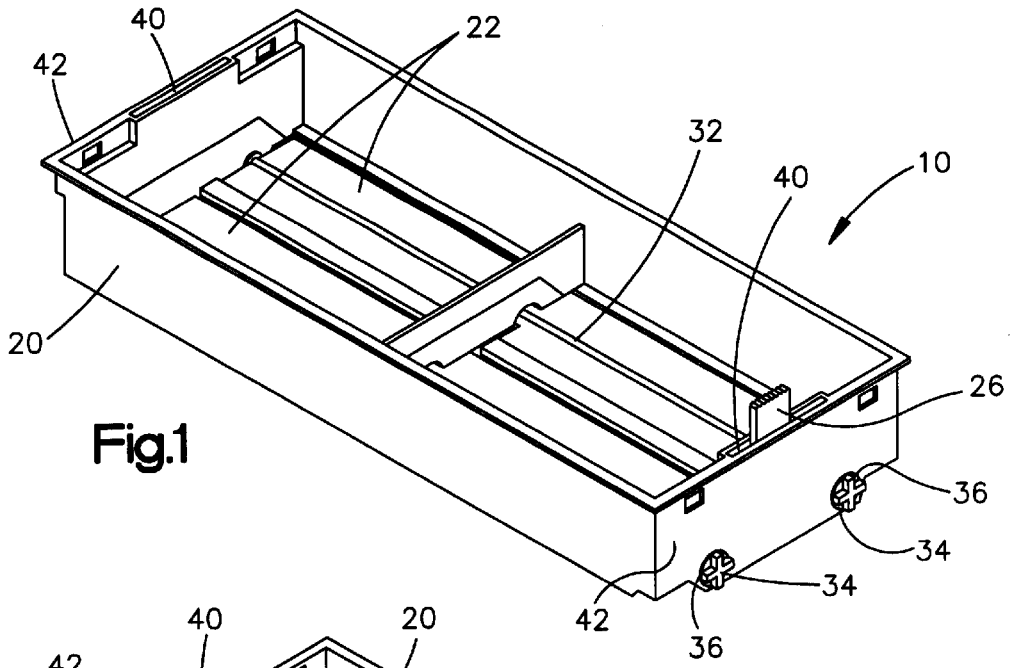
FIG. 1 is a perspective view of a vent damper incorporating the operating mechanism embodying the present invention.
Figure 2:
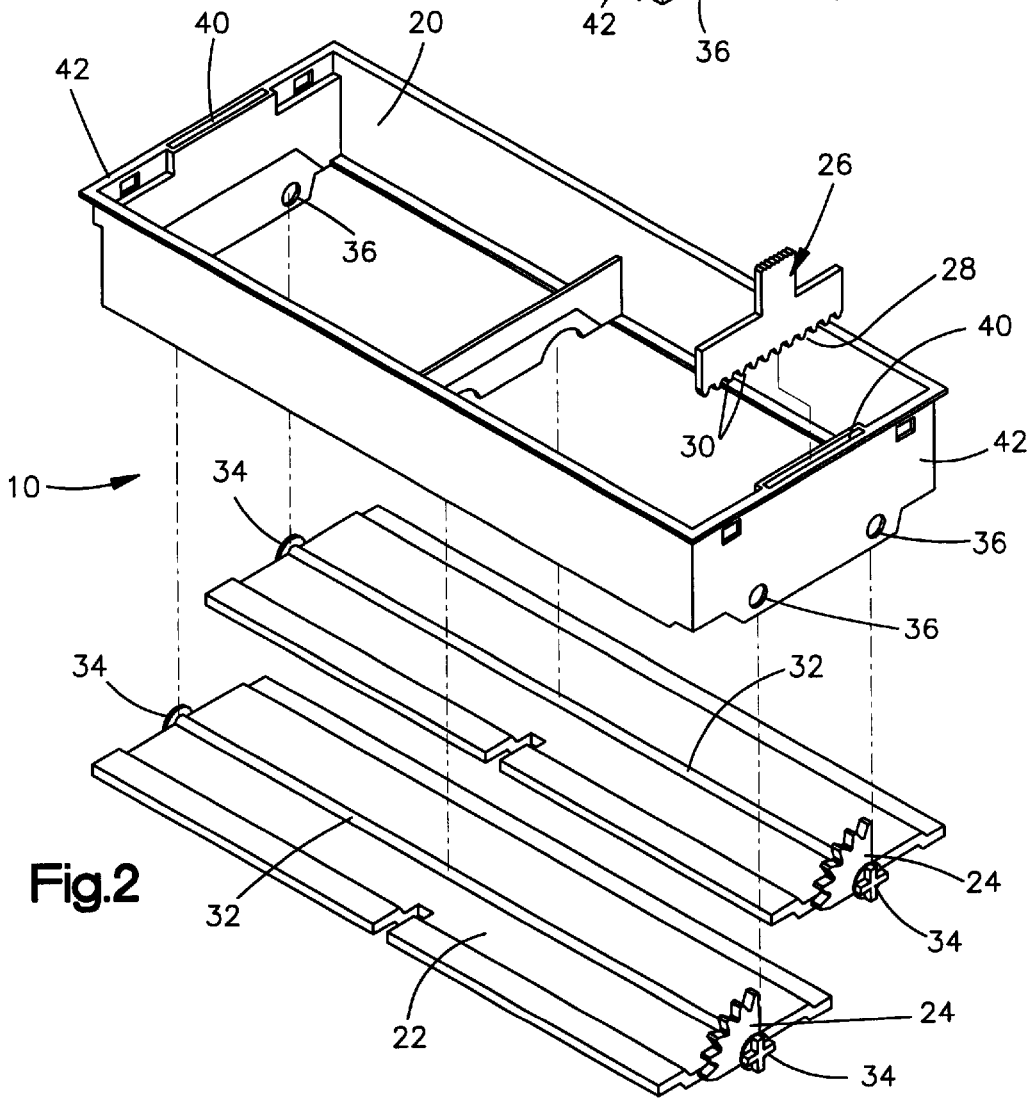
FIG. 2 is an exploded view of the damper.
Figure 3:
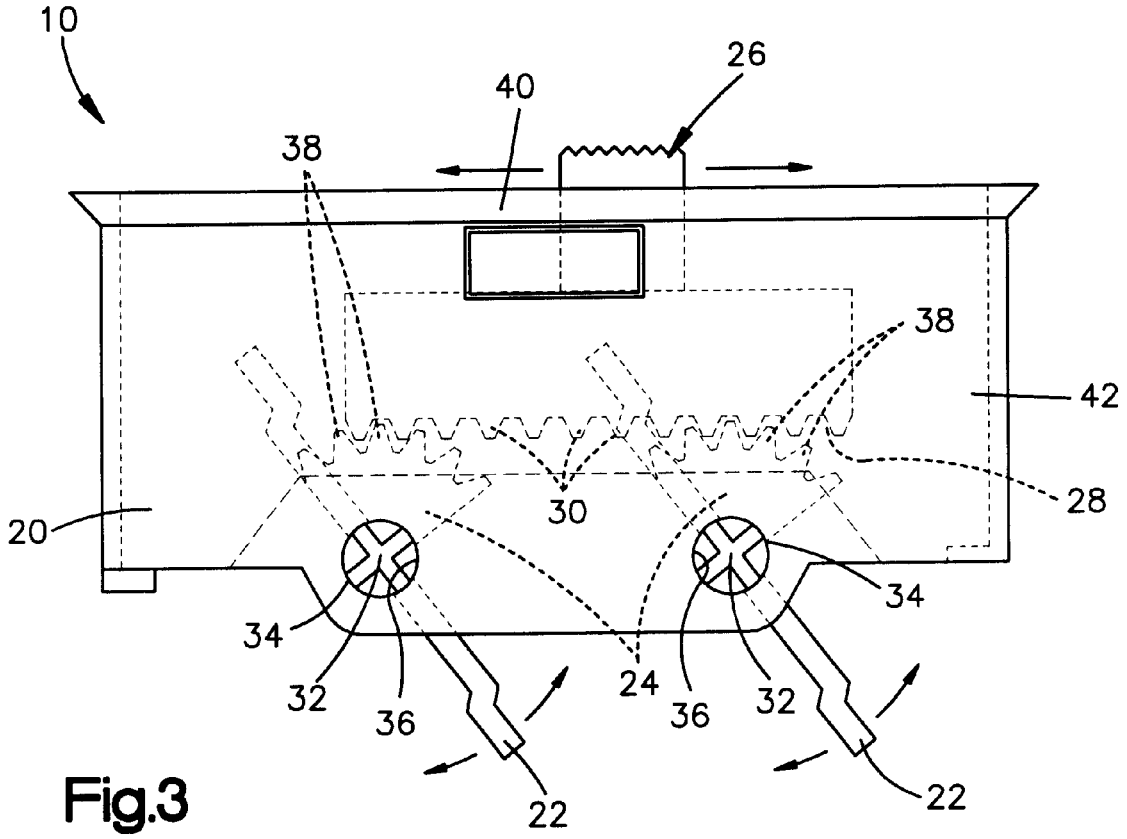
FIG. 3 is an end plan view depicting operation of the damper.
Figure 4:
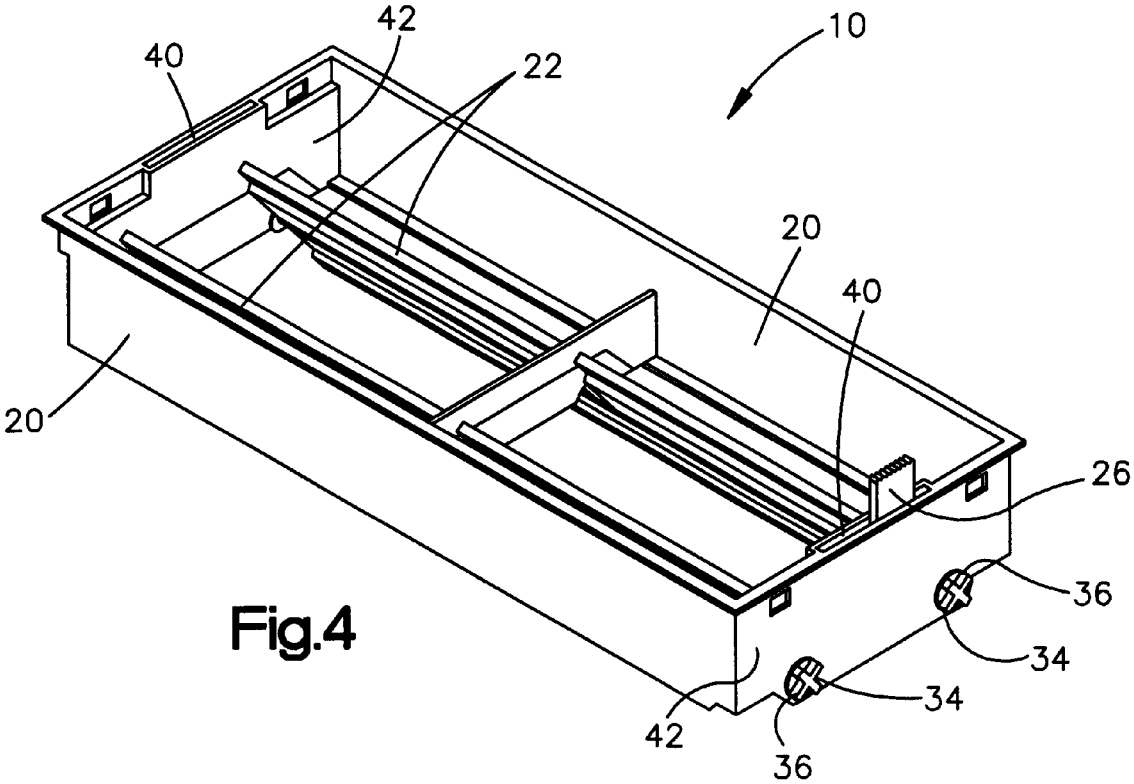
FIG. 4 is a perspective view of the damper showing the louvers in a substantially open position.
Figure 5:
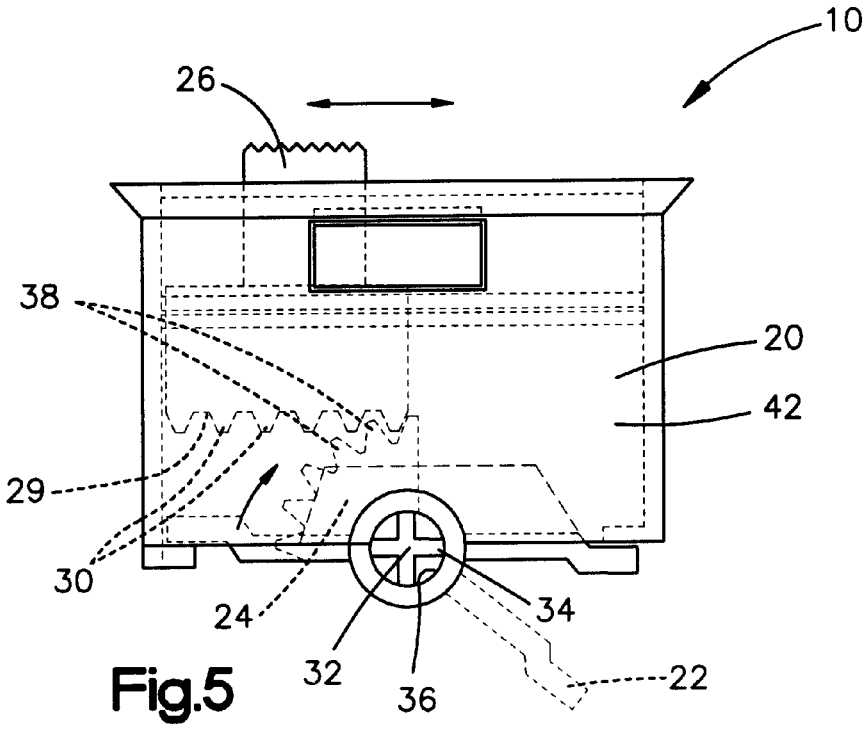
FIG. 5 is an end plan view of an alternative embodiment of the damper assembly.

Referring generally to the drawings, there is shown a vent damper 10 adapted to be seated within an opening of a heating and cooling duct for controlling the flow of air from the HVAC system into a room. The damper 10 may be mounted in an opening formed in a floor, wall or ceiling of the room to control air flow. The damper 10 may be adjusted between a closed (FIG. 1) and an open (FIG. 4) position or to direct flow in a desired direction and dispense air flow across the room.

The damper 10 generally includes a rectangular housing 20 configured to be seated in the vent opening. At least one rotatable louver 22 is mounted across the flow passageway of the housing 20. Each of the louvers 22 has a pinion gear 24 associated with the axis of the louver 22. A slidable lever 26 is mounted to the housing 20 for linear movement within the housing 20. The lever 26 includes a rack portion 28 having a plurality of downwardly depending teeth 30. The rack teeth 30 engage the pinions 24 of the louvers 22 such that sliding movement of the lever 26 will rotate the pinion gears 24 and therefore the louvers 22.

The louvers 22 include a rotational axle 32 having end hubs 34. The hubs 34 are rotatably received within apertures 36 formed in the housing 20 in order to support the louvers 22 along the rear of the housing 20. Associated with at least one of the hubs 34 are the pinion gears 24 having a plurality of gear teeth 38. Preferably, the entire louver 22 including the pinion gear 24 and hub 34 are integrally molded.

The vent housing 20 is formed with at least one slot 40 parallel to an end wall 42 of the housing 20. The slot 40 is configured to slidably receive the lever 26 such that the lever 26 protrudes above the damper 10 for manipulation by the user. Preferably, the housing 20 includes a slot 40 at both ends to allow rearrangement of the lever 26 and the louvers 22 for an alternative air flow.

Thus, as the user linearly manipulates the lever 26 within the slot 40, the linear movement is transmitted to the pinion gears 24 associated with the axis 32 of the louvers 22. Since the pinion gears 24 are circular, or at a minimum, arcuate, movement of the lever 26 will rotate the gears 24 which is transmitted to the louvers 22 to position them as desired.

The foregoing detailed description has been given for clearness of understanding only and no unnecessary limitations should be understood therefrom as some modifications will be obvious to those skilled in the art without departing from the scope and spirit of the appended claims.

What is claimed is:

1. A vent register for controlling the flow of air from a vent, said register comprising:

a housing having a flow passageway;

a plurality of rotatably adjustable louvers mounted within said housing across said passageway, each of said louvers having a pinion gear at one end of said louver; and a linearly movable lever disposed within one end of said housing, said lever having a rack of teeth engaging each said pinion gear of said louvers whereby linear movement of said lever within said housing translates movement to all of said pinions simultaneously for synchronous rotational adjustment of said louvers.

2. The register as defined in claim 1 wherein said housing includes a slot formed in a wall of said housing for slidably receiving said lever.

3. The register as defined in claim 2 wherein said lever includes a tab extending from said slot above said register housing for manipulation by a user.

4. The register as defined in claim 1 wherein said at least one louver includes an axis having hubs formed at outer ends thereof, said hubs rotatably received within corresponding apertures formed in said housing.

5. The register as defined in claim 3 wherein said housing includes slots formed in each end wall of said housing, said end slots selectively receiving said lever for altering the orientation of said at least one adjustable louver.

6. A vent register for controlling the flow of air from a vent, said register comprising:

a housing having a flow passageway, said housing including a slot formed in an end wall of said housing;

a plurality of rotatably adjustable elongated louvers mounted in parallel alignment within said flow passageway of said housing, each of said louvers having end hubs and a pinion gear, said end hubs rotatably received within apertures formed in said walls of said housing; and a linearly movable lever slidably received within said slot of said housing, said lever having a lineal rack of gear teeth directly engaging said pinion gears of each said louvers whereby linear movement of said lever translates movement to all of said pinions simultaneously for synchronous rotational adjustment of said louvers.

7. The register as defined in claim 6 wherein said lever includes a tab extending from said slot above said register housing for manipulation by a user.

8. The register as defined in claim 7 wherein said housing includes slots formed in each end wall of said housing, said end slots selectively receiving said lever for altering the orientation of said at least one adjustable louver.

9. A vent register for controlling the flow of air from a vent, said register comprising:

a housing having a flow passageway, said housing including a lateral slot formed in an end wall of said housing;

a plurality of elongated louvers rotatably mounted in parallel alignment longitudinally within said flow passageway of said housing, each of said louvers having end hubs and a pinion gear, said end hubs rotatably received within apertures formed in said walls of said housing; and a linearly movable lever slidably received within said lateral slot of said housing, said lever having a tab extending from said slot above said housing for manipulation by a user and a lineal rack of gear teeth directly engaging said pinion gears of each of said louvers whereby linear movement of said lever translates movement to all of said pinion gears simultaneously for synchronous rotational adjustment of said louvers within said housing.

* * * * *